US011647796B2

(12) United States Patent
Yankelevich

(10) Patent No.: US 11,647,796 B2
(45) Date of Patent: May 16, 2023

(54) DEVICE FOR SMOKING TOBACCO AND OTHER INHALATION MATERIALS

(71) Applicant: Dmitry Yankelevich, Moreland Hills, OH (US)

(72) Inventor: Dmitry Yankelevich, Moreland Hills, OH (US)

( * ) Notice: Subject to any disclaimer, the term of this patent is extended or adjusted under 35 U.S.C. 154(b) by 374 days.

(21) Appl. No.: 16/872,285

(22) Filed: May 11, 2020

(65) Prior Publication Data

US 2021/0345685 A1 Nov. 11, 2021

(51) Int. Cl.

| | |
|---|---|
| ***A24F 5/00*** | (2006.01) |
| ***A24F 40/65*** | (2020.01) |
| ***A24F 40/20*** | (2020.01) |
| ***A24F 40/42*** | (2020.01) |
| ***A24F 40/10*** | (2020.01) |
| ***A24F 40/57*** | (2020.01) |

(52) U.S. Cl.

CPC ..... *A24F 40/65* (2020.01); *A24F 5/00* (2013.01); *A24F 40/10* (2020.01); *A24F 40/20* (2020.01); *A24F 40/42* (2020.01); *A24F 40/57* (2020.01)

(58) Field of Classification Search

CPC ..... A24F 5/00

See application file for complete search history.

(56) References Cited

U.S. PATENT DOCUMENTS

| | | | | |
|---|---|---|---|---|
| 2012/0255546 | A1* | 10/2012 | Goetz | A61M 11/042 128/202.21 |
| 2017/0099873 | A1* | 4/2017 | Benjamignan | H01M 10/425 |
| 2017/0172209 | A1* | 6/2017 | Saydar | A24F 40/485 |
| 2017/0231283 | A1* | 8/2017 | Gadas | A24F 7/02 131/329 |
| 2021/0177049 | A1* | 6/2021 | Liu | A24F 40/465 |

* cited by examiner

*Primary Examiner* — Cynthia Szewczyk
(74) *Attorney, Agent, or Firm* — Inventa Capital PLC

(57) ABSTRACT

A smoking device includes several parts such as a bottom portion, a core portion, a slide portion, and a housing. The device also includes a bowl. The slide portion presents a rectangular plate having a first end, a second end, side edges. The bottom portion includes a bottom surface and a top surface. The top surface includes a pool defined therein to form a depth and a bottom of the pool. The housing is used to hold a central processing unit, a transmitter, a memory module, and a battery, wherein all these components are operably connected with one another. The central processing unit includes a software that is configured to control dosage, temperature, length of inhaling, etc. The central processing unit is operably connected to the transmitter adaptable to receive wireless signals.

17 Claims, 4 Drawing Sheets

DEVICE FOR SMOKING TOBACCO AND OTHER INHALATION MATERIALS

RELATED APPLICATIONS

This present application is a continuation in part application that claims priority to U.S. patent application Ser. No. 16/584,846 filed on Sep. 26, 2019 and incorporated herewith by reference in its entirety.

FIELD OF INVENTION

The present invention relates generally to vaporizers/inhalator having a cooling chamber that provides minimal pressure drop by creating laminar flow of smoke (inhalation material).

BACKGROUND OF INVENTION

The history of smoking pipes, mouthpieces, and other smoking devices is as old as the modern human history itself. There is tremendous variety of smoking devices exists across the world including those that were created specifically with the purpose of solving the problem of reducing the temperature of the smoking fumes. It is fair to say that each generation of engineers on the modern era at each new phase of progress has contributed solutions for the above stated problem. Present invention is one more step in this direction.

According to the prior art, a smoking pipe typically includes a bowl attached to a stem. A bore extends through the stem and connects to the bottom of the bowl. The stem may separate from a shank that extends laterally from the bowl and through which the bore extends. Often times the bowl and shank are formed as a single piece and the stem inserts into the shank and is held in this manner by a mortise and tenon connection. The interior of the bowl forms a combustion chamber into which a dried or substantially dry material, tobacco or the like, is packed and then ignited. Smoke is drawn through the bore by the smoker. The difficulty of creating the balance between the natural ability of human lungs to create the pressure drop and desired dosage of smoke intake while inhaling has always been the biggest problem of smoking.

Alluding to the above, many people smoke electronic cigarettes or pipes (hereafter referred to as "e-cig vaporizers"), which are designed to produce mere vapor combustion and aerosol inhalant, which are types of imitation smoke because no ash byproduct is produced. Some users turn to other smoking cessation devices and nicotine alternatives: like chewing tobacco, smokeless nicotine patches, nicotine gums, etc., to satisfy their craving to smoke. There are both, holistic (pipe like) vaporizers and e-cig vaporizers available that can do the same thing as each other, produce mere combustion vapor (i.e., imitation smoke that does not produce ash, or in some cases, vapor, sometimes called combustion smoke, from only slightly burning the plant matter to a point short of incinerating the plant matter to ash). However, there are no self-contained electronic smoking devices that incinerate matter into ash and smoke.

The main factor that is causing just said problem is the temperature of the smoke. From the point of view of Physics, the peculiarity of the smoking process is evident: the same suction effort of smoker that provides a flux of ambient air used for burning the certain amount of smoke-producing material is continuing to carry the produced hot smoke directly into the person's lungs. Delivery of hot gases into the lungs does not only cause a very unpleasant burning sensation and sometimes coughing, but also, according to the majority of modern medical studies, is the main cause of destructive effect that smoking imposes to the human's mouth and lungs. Therefore, the problem of decreasing of the temperature of the hot smoke right at the moment of smoking is the very important goal and the technical challenge.

This is a problem for many former and current smokers of cigarettes and tobacco pipes. Instead of chewing gum or inhaling air from conventional non-incineration electric devices, some people would like to enjoy actual smoke and smoked flavor and aroma. Furthermore, some people prefer not to use external heating sources, which may be difficult to aim and even operate in turbulent conditions and are flat out dangerous.

To date, however, the only options a person has for smoking with actual smoke and ash includes traditional tobacco smoke products that are externally heated products or internally heated with gas. All other electronic self-contained smoking devices and e-cig vaporizers are not designed to incinerate plant matter thus they are not designed to create actual smoke and ash, but rather, are designed to create types of imitation smoke.

Therefore, what is needed is a self-contained electronic smoking device with an internal heating source (which essentially functions as a cordless, flame-less lighter) and an open interface in which the smoker can fill and refill, like a pipe, and incinerate the packed pipe matter, producing actual smoke and ash, instead of mere combustion vapor or aerosol.

Therefore, there is a need for a vaporizer/inhalation device which maximizes pressure drop while intensifying heat exchange effect. Furthermore, there is also a need to be a way of operating the vaporizer/inhalator device without using any buttons, touch screens, or motion detectors thereby offering wide range of heating methods, enabling the content to be vaporized at lower temperatures, burned and mid temperatures, or again vaporized at high temperatures.

Alluding to the above, there is also a need for a multi-functional device to provide storage for required inhalation material to offer full portability and ability to be fully disassembled for cleaning. Finally, there is a need for the multifunctional device adaptable to provide data of its usage over internet as well as able to be operated via internet.

SUMMARY OF THE INVENTION

A smoking vaporization/inhalation device includes several parts such as a bottom portion, a core portion, and a slide portion. The device also includes a bowl. The slide portion presents a rectangular plate having a first end, a second end, and side edges. A pair of openings are formed at the first end, wherein the opening is used to receive the bowl. The bottom portion presents a generally rectangular configuration without limiting the scope of the present invention. The bottom portion includes a bottom surface and a top surface wherein the width of the top surface is wider than the width of the bottom surface whereby the side walls are concave.

The top surface further presents a pool defined therein to form a depth and a bottom of the pool. The pool presents a meshed surface comprised of a multitude of cavities. The pool extends to an outlet defined at a first end of the bottom portion. The outlet presents a semicircular configuration without limiting the scope of the present invention.

The core portion includes a bottom surface and a top surface wherein the width of the top surface is shorter than the width of the bottom surface whereby side walls are straight as they extend from the bottom surface and then incline as they extend to the top surface. The core portion includes a first end and a second end. The core portion includes an opening adjacent the first end of the core portion defined therein to fixedly secure a metallic mesh. The top surface includes a peripheral rail extending about the top surface except the part at the first end to allow the slide portion to be inserted therein and slide about the top surface wherein the openings are aligned with one another to receive the bowl secured thereby. The bottom surface presents a meshed surface comprised of a second multitude of cavities. A channel is defined at the second end. The channel presents a collector and a passage extending from the collector to complement with the outlet of the bottom portion.

The core portion includes a bottom surface and a top surface. The core portion includes side walls are straight as they extend from the bottom surface and then incline as they extend to the top surface. The core portion includes a first end and a second end. The core portion includes an opening adjacent the first end to receive the bowl. When assembled, the bottom surface of the core portion covers the top surface of the bottom portion to cover the pool. A second pool is formed in the top surface. The second pool extends to the opening.

The housing is used to hold the central processing unit, the transmitter, the memory module, and the battery, wherein all these components are operably connected with one another. The central processing unit includes a software that is configured to control dosage, temperature, length of inhaling, etc. The central processing unit is operably connected to the transmitter adaptable to receive wireless signals. The memory module is operably communicated with the transmitter and the central processing unit and the battery. The housing includes a first button and a second button is located in the core portion. The first button and the second button are operably communicated with the central processing unit, the transmitter, the memory module, and the battery.

A first alternative embodiment of the bowl includes a bottom portion, having a central part and a rim extending outwardly from the central part to define a radial notch to secure the slide portion. A concave side extends to a central opening extending to a central channel defined in the central part. Oils to be heated in the central opening will fill the channel to allow fumes to enter the device to be inhaled by the user. When in use, the oils are not combusted but rather vaporized at high temperature thus not producing much ash. The bowl is formed from metal but can be formed from other material without limiting the scope of the present invention. The bowl may have a circular configuration as well and the rectangular and is not intended to limit the scope of the present invention. The bowl may include magnets to magnetically connect with respective metal or any other non-magnetic elements defined in the slide portion to form secure connection between the slide portion and the bowl.

A second alternative embodiment of the bowl device includes a bottom part presenting a sleeve and disposed in the openings defined in the bottom portion and the core portion of the device. A funnel element includes a cup extending to an extension presenting a channel fluidly communicating with the sleeve. The extension is disposed inside the sleeve. Oils to be heated in the cup fill the channel to allow fumes to enter the device to be inhaled by the user. When in use, the oils are not combusted but rather vaporized at high temperature thus not producing much ash. The bowl device is formed from metal but can be formed from other material without limiting the scope of the present invention.

It is the object of present invention to teach the means of using Vortical Boiling Phenomenon of heat exchange at the convective cooling for cooling of smoke inside the smoking pipe up to full recuperation with the temperature of the human body before this smoke has reached the person's lungs.

The invented smoking pipe offers the means for making a full draw of the desired dosage of smoke into the lungs using minimal suction effort. Indeed, when trying to reach the maximum smoking effect a person needs to inhale as much smoke as possible.

The present invention depicts the smoking apparatus which eliminates the need for restrictive airflow by cooling the hot smoke to the human body temperature thus allowing bigger draw of smoke into the lungs and holding it in for longer period of time, therefore increasing the smoking effect.

The present invention offers a self-contained electronic smoking device with an internal heating source (which essentially functions as a cordless, flame-less lighter) and an open interface in which the smoker can fill and refill, like a pipe, and incinerate the packed pipe matter, producing actual smoke and ash, instead of mere combustion vapor or aerosol.

The present invention offers a vaporizer/inhalation device which maximizes pressure drop while intensifying heat exchange effect and allowing the vaporizer/inhalator device to function without using any buttons, touch screens, or motion detectors thereby offering wide range of heating methods, enabling the content to be vaporized at lower temperatures, burned and mid temperatures, or again vaporized at high temperatures.

The present invention offers a multifunctional device to provide storage for required inhalation material to offer full portability and ability to be fully disassembled for cleaning. Finally, there is a need for the multifunctional device adaptable to provide data of its usage over internet as well as able to be operated via internet.

BRIEF DESCRIPTION OF THE DRAWINGS

Other advantages of the present invention will be readily appreciated as the same becomes better understood by reference to the following detailed description when considered in connection with the accompanying drawings wherein.

Advantages and features of the present invention are better understood with reference to the following more detailed description and claims taken in conjunction with accompanying drawings.

DETAILED DESCRIPTION OF THE INVENTION

Figure 1:
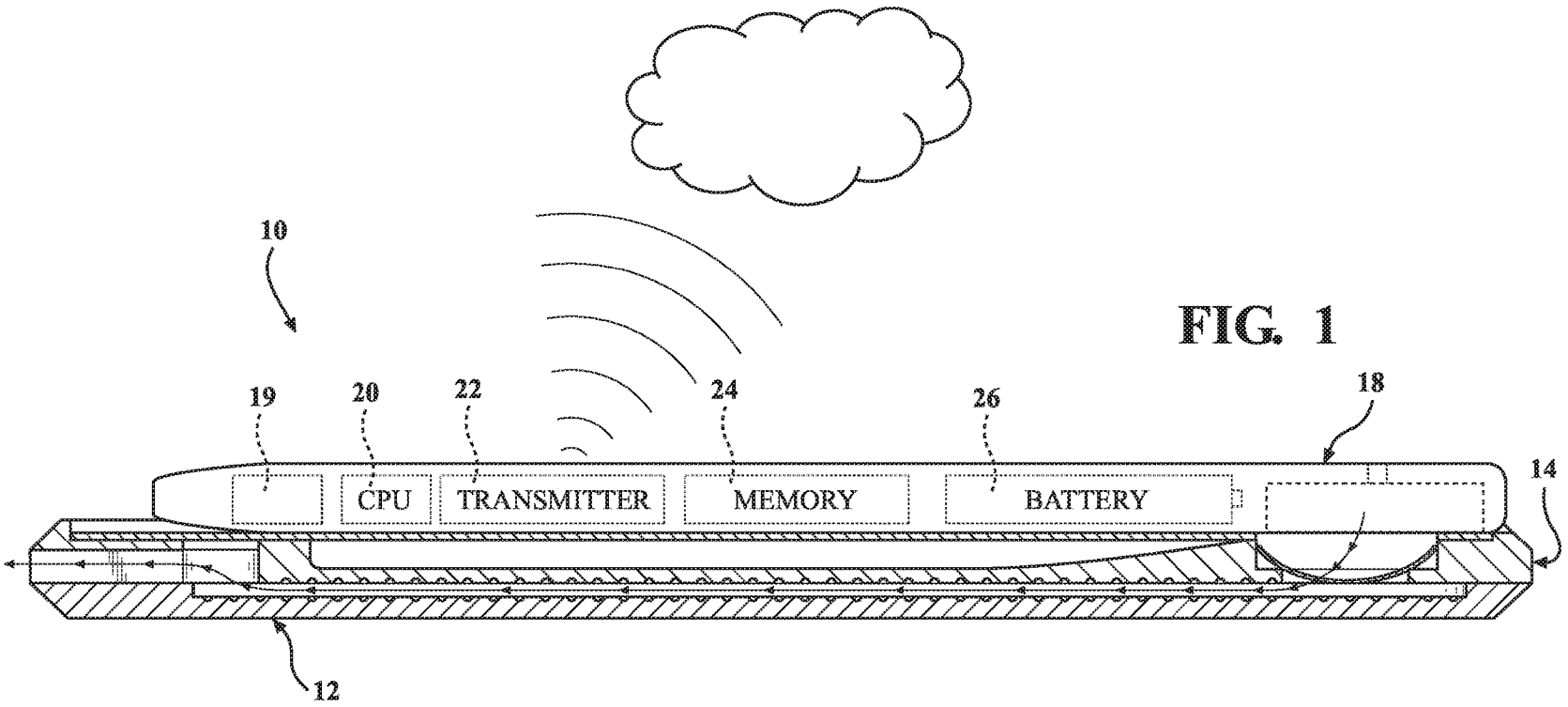
FIG. 1 shows a partially cross sectional view a pipe device, such as vaporizers/inhalator, including a housing to keep a CPU unit, a transmitter, a memory unit, and a battery.
Figure 2:
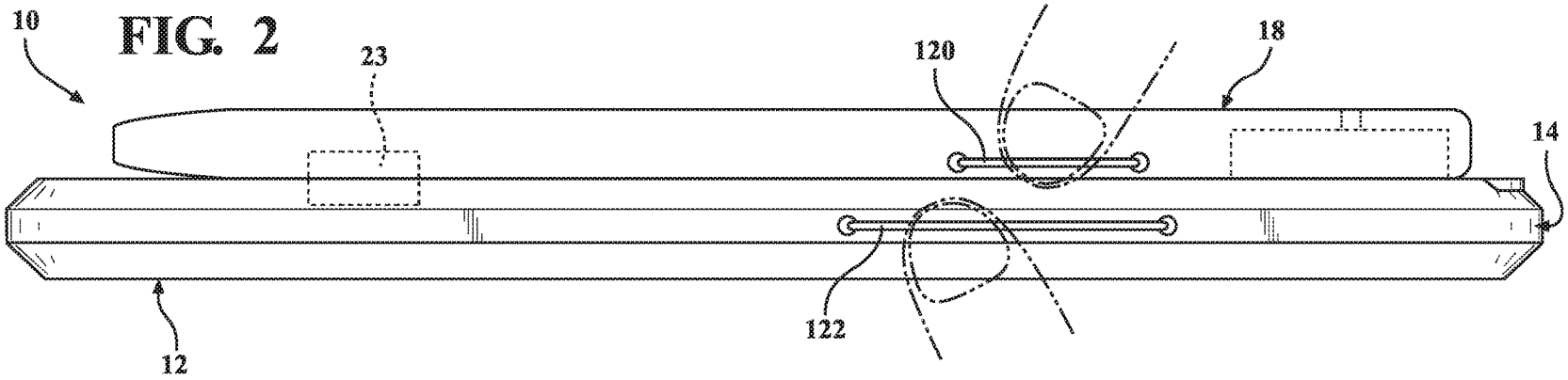
FIG. 2 is a side view of the pipe device as shown in FIG. 1.

Referring to the Figures, wherein like numerals indicate like or corresponding parts, FIGS. 1 and 2, for example, illustrate a smoking device, such as vaporizers/inhalator, of the present invention, generally shown at 10. It will be apparent that multiple embodiments of this disclosure may be practiced without some or all of these specific details. In other instances, well-known process operations have not been described in detail in order not to unnecessarily obscure the present embodiments. The following description of embodiments includes references to the accompanying drawing. The drawing shows illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Alluding to the above, for purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

As shown in FIGS. 1 and 2, the smoking pipe, such as vaporizers/inhalator, (here and after as the device) is generally shown at 10. The device 10 includes several parts such as a bottom portion, generally indicated at 12, a core portion, generally indicated at 14, and a housing 18 for holding a mother board 19, a central processing unit 20, a transmitter 22, a circuit operably connecting and extending between the core portion 14 and the housing 18, a memory 24, and a battery 26, wherein all these components are operably connected with one another.

The device 10 also includes a bowl device adaptable for vaporizing (here and after as "bowl" or "bowl element"), generally indicated at 28, and to be described further below. The bottom portion 12 includes a first end 40, a second end 42, side edges 44, 46, and side walls 48, 50, 52, and 54. The bottom portion 12 presents a generally rectangular configuration without limiting the scope of the present invention.

Figure 5:
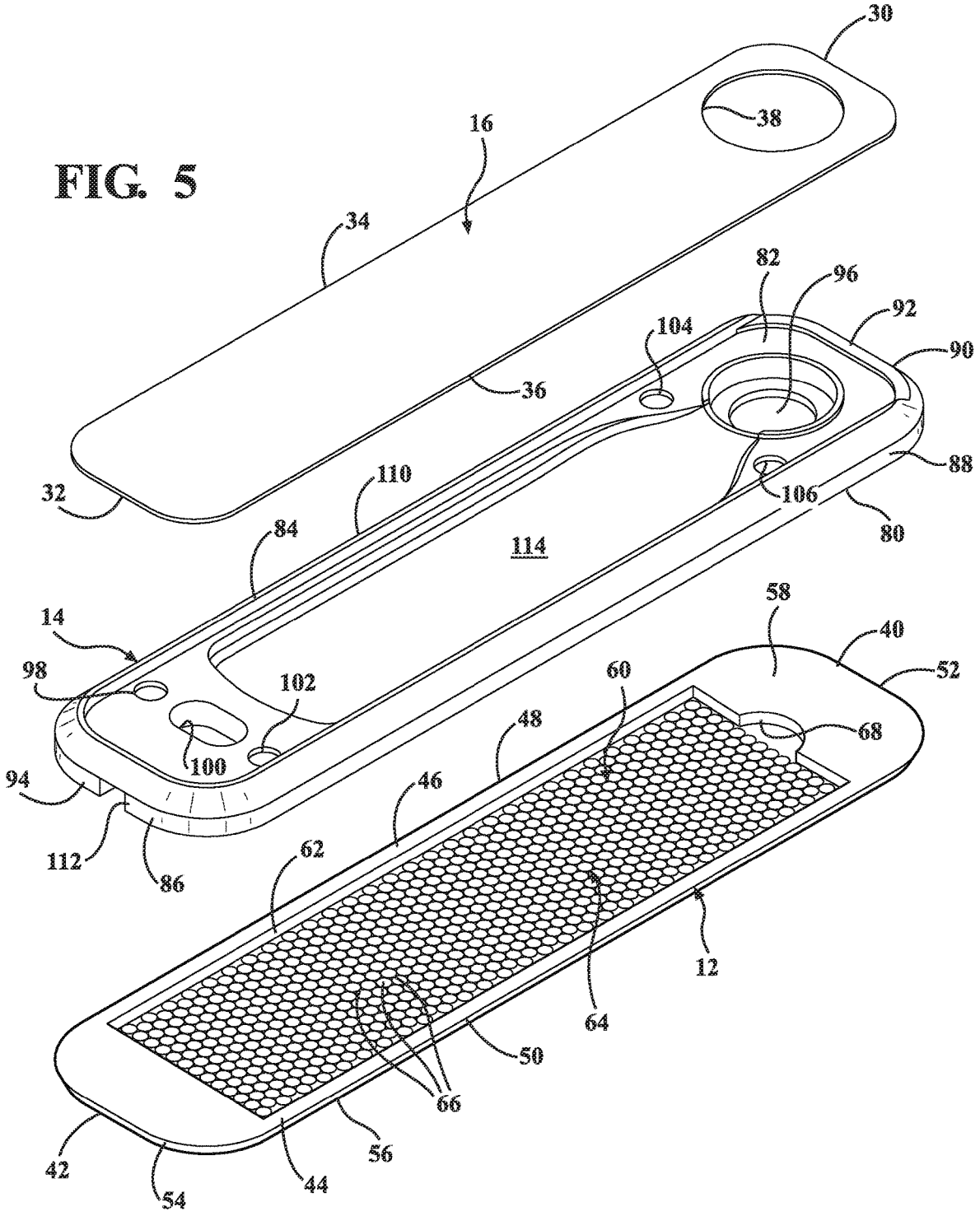
FIG. 5 shows a perspective and exploded view of the pipe device.

As shown in FIG. 5, the bottom portion 12 includes a bottom surface 56 and a top surface 58. The top surface 58 further presents a pool, generally indicated at 60, defined therein to form a depth 62 and a bottom, generally indicated at 64 of the pool 60. The pool 60 present a meshed surface, generally indicated at 64, comprised on a multitude of cavities 66. The pool 60 extends to an outlet 68 defined at the first end 40 of the bottom portion 12. The outlet 68 presents a semicircular configuration without limiting the scope of the present invention.

Figure 3:
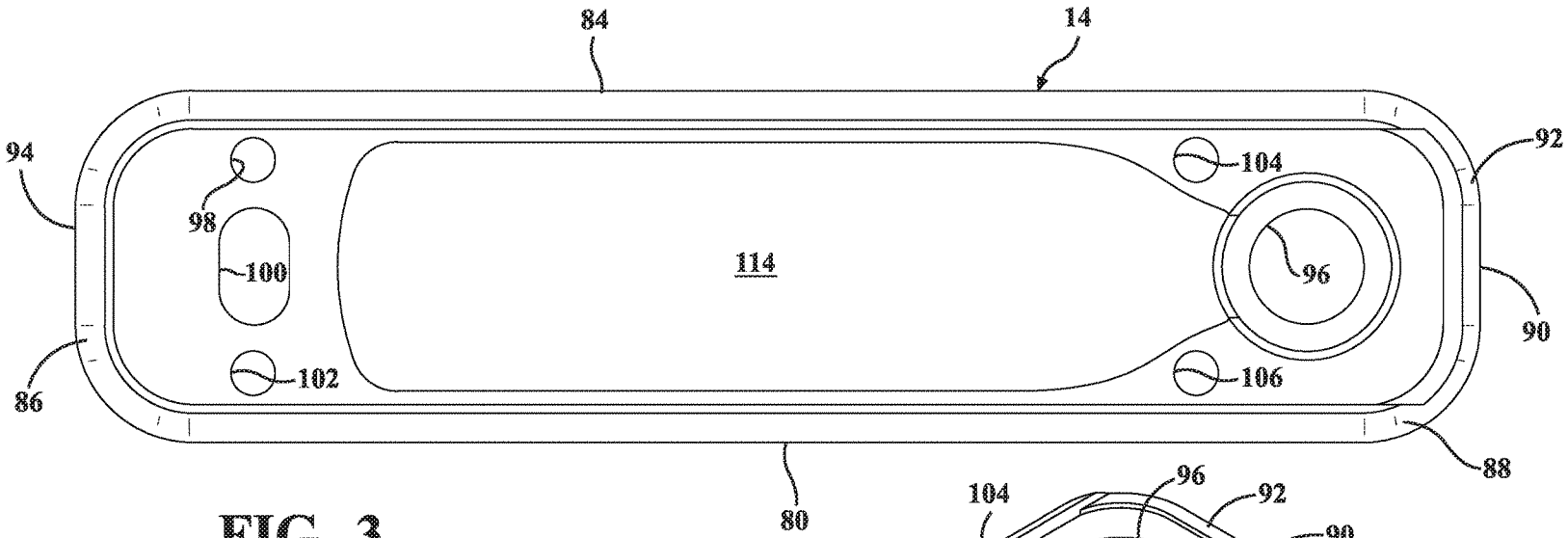
FIG. 3 shows a top view of a core portion.
Figure 4:
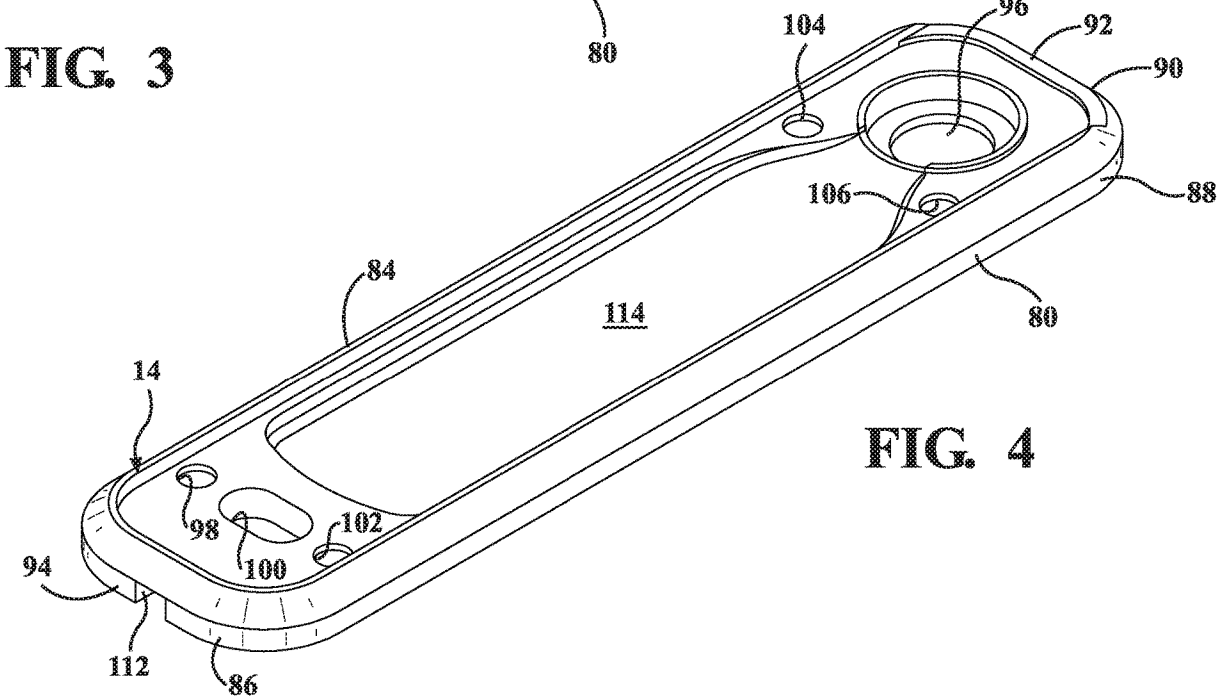
FIG. 4 shows a perspective view of the core portion shown in FIG. 3.

As best shown in FIGS. 3 through 5, the core portion 14 includes an insert 16 presenting a rectangular plate having a first end 30, a second end 32, side edges 34, 36. An opening 38 is formed at the first end 30, wherein the opening 38 is used to receive the bowl 28. a bottom surface 80 and a top surface 82. The core portion 14 includes side walls 84, 86, 88, and 90 are straight as they extend from the bottom surface 80 and then incline as they extend to the top surface 82. The core portion 14 includes a first end 92 and a second end 94. The core portion 14 includes an opening 96 adjacent the first end 92 to receive the bowl 28. There several openings 98, 100, 102, 104, and 106 defined at the first end 92 and the second end 94.

Alluding to the above, these several openings 98, 100, 102, 104, and 106 are used for magnets to hold the insert 16 in place. The top surface 82 includes a peripheral rail 110 extending about the top surface 82 expect the part at the first end 92 to allow the slide portion 16 to be inserted therein and slide about the top surface 82 wherein the opening 96 and the opening 38 are aligned with one another to receive the bowl 28 secured thereby. The bottom surface 80 presents a meshed surface comprised of a multitude of cavities (not shown).

A channel 112 is defined at the second end 94. When assembled, the bottom surface 80 of the core portion 14 covers the top surface 58 of the bottom portion 12 to cover the pool 60. A second pool 114 is formed in the top surface 82. The second pool 114 extends to the opening 96. The second pool 114 is used for keeping different elements like consumable material or battery, without limiting the scope of the present invention.

As best shown in FIG. 1, the housing 18 is used to hold a mother board 19 the central processing unit 20, the transmitter 22, the memory 24, and the battery 26, wherein all these components are operably connected with one another. The central processing unit 20 includes a software that is configured to control dosage, temperature, length of inhaling, etc. The central processing unit 20 is operably connected to the transmitter 22 adaptable to receive wireless signals. The memory 24 is operably communicated with the transmitter 22 and the central processing unit 20 and the battery 26. In one aspect of the present invention, the housing includes a first element, i.e. a wire 120 and a second element, i.e. the wire 122 is located in the core portion 14, without limiting the scope of invention. The first element 120 is operably communicated with the mother board, the central processing unit 20, the transmitter 22, the memory 24, and the battery 26. The system allows to record usage dosage, give user the information, vaporize material, etc. When user touches the elements 120 and 122 at the same time, the circuit 23 gives signal to the mother board 19 and the mother board sends signal to the central processing unit 20. The signals initiated, transmitted, stored, processed, and managed in this way may include, without limitation, commands to start or stop vaporization process or give notifications through vibration, sound, or light emitting devices (not included in the embodiment).

Figure 6:
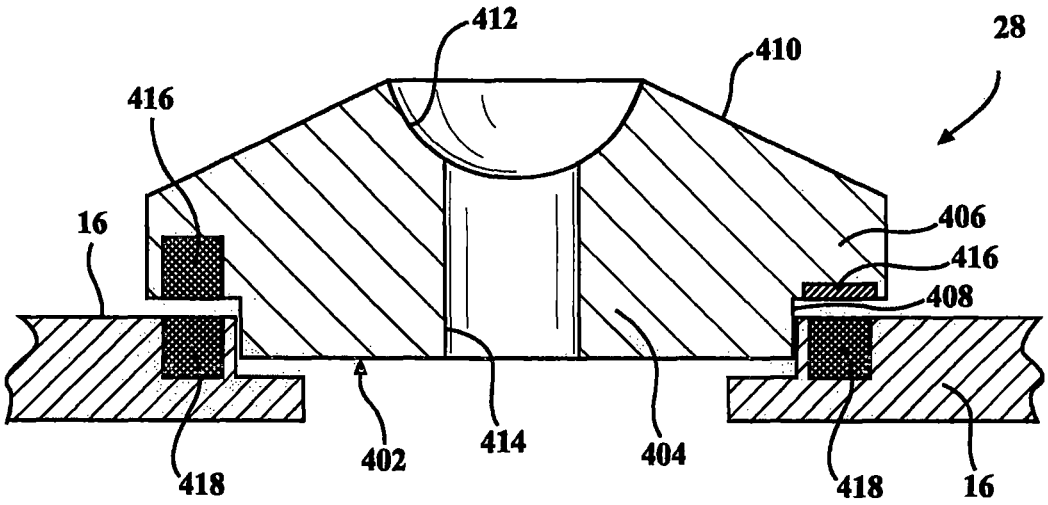
FIG. 6 shows a cross sectional view of an alternative embodiment of a bowl.

As shown in FIG. 6, the bowl 28 includes a bottom portion, generally indicated at 402, having a central part 404 and a rim 406 extending outwardly from the central part 404 to define a radial notch 408 to secure the slide portion 16. A concave side 410 extends to a central opening 412 extending to a central channel 414 defined in the central part 404.

Oils and other smoking substances to be heated in the central opening 412 will fill the channel 414 to allow fumes to enter the device 10 to be inhaled by the user. When in use, the oils are not combusted but rather vaporized at high temperature thus not producing much ash. The bowl 28 is formed from metal but can be formed from other material without limiting the scope of the present invention. The bowl 28 may have a circular configuration as well and the rectangular and is not intended to limit the scope of the present invention. The bowl 28 may include magnets 416 to magnetically connect with respective metal or any other nonmagnetic elements 418 defined in the slide portion 16 to form secure connection between the slide portion 16 and the bowl 28. The bowl 28 may include magnets 416 or ferric metal 444 to magnetically connect to magnets within the pipe 16. Further, the bowl stem 508 can be inserted into the channel 414 in the same way it is secured onto channel 502.

Figure 7:
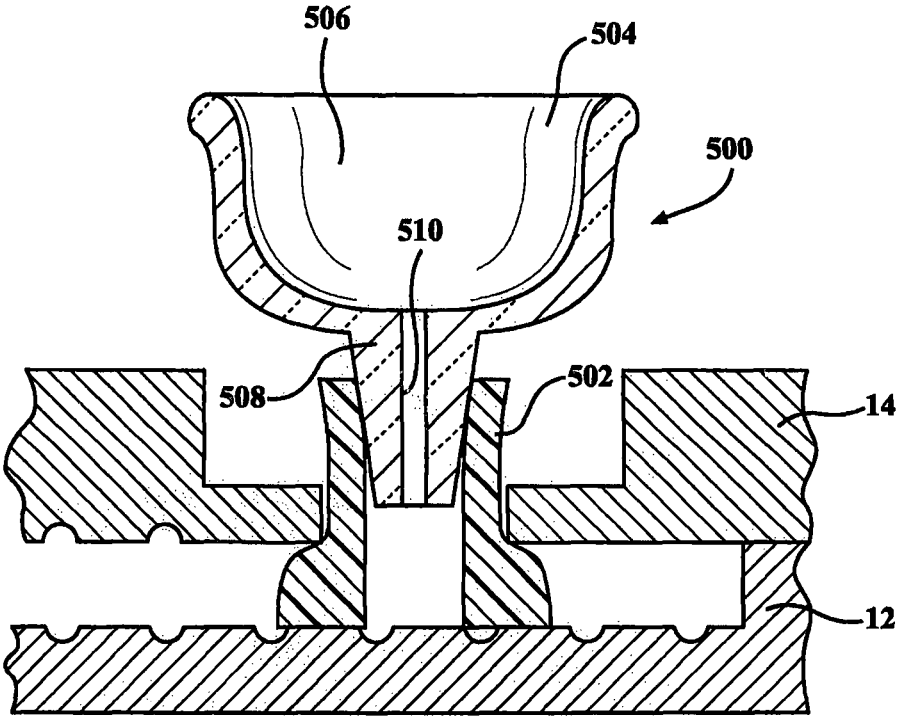
FIG. 7 shows a cross sectional view of another alternative embodiment of a bowl.

As shown in FIG. 7, a second alternative embodiment of the bowl device is generally shown at 500. The bowl device 500 includes a bottom part presenting a sleeve 502 and disposed in the openings defined in the bottom portion and the core portion of the device 10. A funnel element 504 includes a cup 506 extending to an extension 508 presenting a channel 510 fluidly communicating with the sleeve 502. The extension 508 is disposed inside the sleeve 502.

Alluding to the above, oils to be heated in the cup 506 will fill the channel 510 to allow fumes to enter the device 10 to be inhaled by the user. When in use, the oils are not combusted but rather vaporized at high temperature thus not producing much ash. The bowl device 500 is formed from metal but can be formed from other material without limiting the scope of the present invention.

While the invention has been described with reference to an exemplary embodiment, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof.

Therefore, it is intended that the invention not be limited to the particular embodiment disclosed as the best mode contemplated for carrying out this invention, but that the invention will include all embodiments falling within the scope of the appended claims.

What is claimed is:

1. A device for smoking and vaporizing tobacco and inhalation materials, said device comprising;

a body including a bottom portion, a core portion, and a slide portion;

a bowl connected to said body, said bowl including a bottom portion having a central part and a radial rim extending outwardly from said central part to define a radial notch to secure said slide portion, said bowl includes a base plate and a concave top extending to a central tube portion, said bowl presents a gradient thickness of sides wherein at least one of said sides is thicker than the other of said sides to manipulate and control temperature of the oil heated inside said bowl; and a housing connected to said core portion to hold a central processing unit, a transmitter, a memory unit, a battery operably connected with one another, said central processing including a software configured to control dosage, temperature, length of inhaling, where operational signals are initiated, transmitted, stored, processed, and managed via a wire network and at least one circuit, said housing holding a mother board cooperable with said central processing unit with a software configured to control dosage, temperature, length of inhaling, wherein said central processing unit is operably connected to said transmitter adaptable to receive wireless signals.

2. The device as set forth in claim 1, wherein said bottom portion includes a bottom surface and a top surface wherein the width of said top surface is wider than the width of said bottom surface whereby said top surface further presents a pool defined therein to form a depth and a bottom of said pool, said pool presenting a first meshed surface comprised of a first multitude of cavities and said bottom surface of said core portion presenting a second meshed surface comprised of a second multitude of cavities with a channel defined in said core portion presenting a collector and a passage extending from said collector to complement with an outlet of said top surface of said bottom portion as said core portion covers said bottom portion to cover said pool thereby allowing a user to inhale fume as the fume is cooled while passing through said meshed surfaces of said pool and escaping through said channel.

3. The device as set forth in claim 1, wherein said slide portion presents a rectangular plate having a first end, a second end, side edges, and a pair of openings formed at said first end, wherein said opening is used to receive said bowl.

4. The device as set forth in claim 1, wherein said bottom portion includes a first end, a second end, side edges, and side walls, said bottom portion presenting a generally rectangular configuration.

5. The device as set forth in claim 1, wherein a pool extends to an outlet defined at a first end of said bottom portion, said outlet presenting a semicircular configuration.

6. The device as set forth in claim 5, including a metallic mesh fixedly secured within a opening of said core portion.

7. The device as set forth in claim 6, wherein a central portion extends further to a base plate having a generally rectangular sides and a concave top extending to a central tube portion with a plurality of rims of a generally circular configuration, whereby said opening of said slide portion and a opening of said core portion as aligned with one another receive said bowl secured by said slide portion engage said radial notch to secure said bowl therein during operating mode of said device.

8. The device as set forth in claim 6, including a bowl portion defined on the top of a central tube portion, said bowl portion formed by a peripheral side wall surrounding the end of said central tube portion wherein oils to be heated fill the voids defined between said peripheral side wall and said central tube portion extending to a central opening fluidly connected with a central portion to allow fumes to enter said device to be inhaled by the user.

9. The device as set forth in claim 8, including a bowl portion defined on the top of said central tube portion, said bowl portion formed by a peripheral side wall surrounding the end of said central tube portion wherein oils to be heated fill the voids defined between said peripheral side wall and said central tube portion extending to a central opening fluidly connected with said central portion to allow fumes to enter said device to be inhaled by the user.

10. The device as set forth in claim 9, wherein said bowl is formed from at least one of metal, metal alloys, and heat resistant materials.

11. The device as set forth in claim 10, including a concave side extending to a central opening extending to a central channel defined in said central part wherein oils to be heated in said central opening fill said channel to allow fumes to enter said device to be inhaled by the user.

12. The device as set forth in claim 11, wherein said bowl includes magnets to magnetically connect with respective metal or any other nonmagnetic elements defined in said slide portion to form secure connection between said slide portion and said bowl.

13. The device as set forth in claim 1, wherein the width of said a top surface is shorter than the width of a bottom surface whereby side walls are straight as they extend from said bottom surface and then incline as they extend to said top surface.

14. The device as set forth in claim 1, wherein said core portion includes a first end and a second end, a top surface of said core portion including a peripheral rail extending about said top surface except said first end of said core portion to allow said slide portion to be inserted therein and slide about said top surface said a opening defined in said slide portion and an opening defined in said core portion are aligned with one another to receive said bowl secured thereby.

15. The device as set forth in claim 1, including a bottom part presenting a sleeve and disposed in openings defined in said bottom portion and said core portion of said device, further including a cup extending to an extension presenting a channel fluidly communicating with said sleeve.

16. The device as set forth in claim 15, including an extension disposed inside said sleeve, wherein oils to be heated in said cup will fill said channel to allow fumes to enter said device to be inhaled by the user.

17. The device as set forth in claim 1, wherein said housing includes a first element and a second element is located in said core portion, said first element operably communicated with said mother board, said central processing unit, said transmitter, said memory, and said battery, wherein said first element and said second element in response to external impact, allow said circuit to signal to said mother board to send further signal to said central processing unit.

* * * * *